US010014582B2

(12) United States Patent
Ryu et al.

(10) Patent No.: US 10,014,582 B2
(45) Date of Patent: Jul. 3, 2018

(54) ANTENNA MODULE AND MOBILE TERMINAL INCLUDING SAME

(71) Applicant: LG ELECTRONICS INC., Seoul (KR)

(72) Inventors: Seungwoo Ryu, Seoul (KR); Hyengcheul Choi, Seoul (KR); Chisang You, Seoul (KR); Soyeon Lee, Seoul (KR); Kyoungsun Hwang, Seoul (KR); Songyi Lee, Seoul (KR); Byungeun Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 295 days.

(21) Appl. No.: 14/765,262

(22) PCT Filed: Oct. 24, 2013

(86) PCT No.: PCT/KR2013/009501
§ 371 (c)(1),
(2) Date: Jul. 31, 2015

(87) PCT Pub. No.: WO2014/142411
PCT Pub. Date: Sep. 18, 2014

(65) Prior Publication Data

US 2015/0380825 A1 Dec. 31, 2015

(30) Foreign Application Priority Data

Mar. 15, 2013 (KR) ..... 10-2013-0028206
Apr. 15, 2013 (KR) ..... 10-2013-0041137

(51) Int. Cl.
*H01Q 21/00* (2006.01)
*H01Q 9/16* (2006.01)
(Continued)

(52) U.S. Cl.
CPC ..... *H01Q 9/16* (2013.01); *H01Q 1/243* (2013.01); *H01Q 1/50* (2013.01); *H01Q 5/40* (2015.01); *H01Q 9/42* (2013.01); *H01Q 21/30* (2013.01)

(58) Field of Classification Search
None
See application file for complete search history.

(56) References Cited

U.S. PATENT DOCUMENTS

2006/0071864 A1 4/2006 Richard et al.
2007/0146221 A1 6/2007 Oshiyama et al.
(Continued)

FOREIGN PATENT DOCUMENTS

CN 1496610 A 5/2004
CN 1992434 A 7/2007
(Continued)

OTHER PUBLICATIONS

Suh et al., Abstract of "High isolation antenna for multiradio antenna system using a complementary antenna pair", Antennas and Propagation Society International Symposium, 2007 IEEE, Jun. 9-15, 2007, pp. 1229-1232.

*Primary Examiner* — Graham Smith
(74) *Attorney, Agent, or Firm* — Birch, Stewart, Kolasch & Birch, LLP

(57) ABSTRACT

Disclosed are an antenna module and a mobile terminal having the same. The antenna module includes: a first member and a second member configured to operate as radiators of an antenna for transmitting/receiving radio signals; a first feeding unit configured to feed the first and second members; and a transmission line configured to connect the second member to the first feeding unit so that, when the first member forms a magnetic field in a near field, the second member forms an electric field.

21 Claims, 12 Drawing Sheets

(51) Int. Cl.

| | |
|---|---|
| ***H01Q 1/24*** | (2006.01) |
| ***H01Q 9/42*** | (2006.01) |
| ***H01Q 5/40*** | (2015.01) |
| ***H01Q 1/50*** | (2006.01) |
| ***H01Q 21/30*** | (2006.01) |

(56) References Cited

U.S. PATENT DOCUMENTS

| | | | | |
|---|---|---|---|---|
| 2008/0122698 | A1 | 5/2008 | Ollikainen et al. | |
| 2011/0287731 | A1* | 11/2011 | Hase ..... | H01Q 9/16 455/269 |
| 2013/0016024 | A1 | 1/2013 | Shi et al. | |

FOREIGN PATENT DOCUMENTS

| | | | |
|---|---|---|---|
| CN | 101512835 | A | 8/2009 |
| CN | 202487756 | U | 10/2012 |
| CN | 102916244 | A | 2/2013 |
| JP | 2009-200869 | A | 9/2009 |
| KR | 10-2009-0067896 | A | 6/2009 |
| KR | 10-2009-0076197 | A | 7/2009 |

* cited by examiner

ANTENNA MODULE AND MOBILE TERMINAL INCLUDING SAME

CROSS REFERENCE TO RELATED APPLICATIONS

This application is the National Phase of PCT International Application No. PCT/KR2013/009501, filed on Oct. 24, 2013, which claims priority under 35 U.S.C. 119(a) to Patent Application No. 10-2013-0028206, filed in the Republic of Korea on Mar. 15, 2013, and to Patent Application No. 10-2013-0041137, filed in the Republic of Korea on Apr. 15, 2013, all of which are hereby expressly incorporated by reference into the present application.

TECHNICAL FIELD

The present disclosure relates to a mobile terminal having an antenna module for transmitting/receiving radio signals.

BACKGROUND ART

A mobile terminal is a portable device that can be carried anywhere and have one or more of a function of performing voice and video calls, a function of inputting/outputting information, a function of storing data, etc.

As the mobile terminal becomes multifunctional, the mobile terminal can be allowed to capture still images or moving images, play music or video files, play games, receive broadcast, etc., so as to be implemented as an integrated multimedia player.

In order to support and enhance such functions of the terminal, it can be considered to improve the configuration and/or software of the terminal. For instance, a user interface (UI) which allows a user to search or select a desired function easily and conveniently is being provided.

In addition to the attempts, plans for enhancing the function of the hardware, etc. may be considered. The plans include structural changes and improvements for allowing a user to more conveniently use a mobile terminal. An antenna for transmitting/receiving radio waves may be considered as one of the structural changes and improvements.

An antenna is a device configured to transmit/receive radio electromagnetic waves for radio communication. The antenna is a component essentially required in a mobile terminal. As the mobile terminal is provided with various functions such as WiBro and DMB, rather than a voice call, the antenna should be configured to implement bandwidths which satisfy the functions. In addition, the antenna should be designed in a small size to be embedded in the mobile terminal.

In order to meet such demand, antennas capable of implementing a multi-frequency band are being designed. However, such antennas have a complicated structure, and it is difficult to independently control parameter values which determine antenna characteristics such as a resonance frequency, a bandwidth and a gain.

Further, in an antenna module performing MIMO or diversity, the performance of antennas is degraded due to the interaction between the antennas.

Accordingly, in order to solve such problems, studies on an antenna having a new structure have actively conducted.

SUMMARY OF THE INVENTION

Therefore, an object of the present disclosure is to provide a mobile terminal having an antenna module with more improved performance.

Another object of the present disclosure is to provide an antenna module which has a more improved structure and can more efficiently perform a mobile communication service such as MIMO or diversity.

To achieve these and other advantages and in accordance with the purpose of the present disclosure, as embodied and broadly described herein, there is provided an antenna module including: a first member and a second member configured to operate as radiators of an antenna for transmitting/receiving radio signals; a first feeding unit configured to feed the first and second members; and a transmission line configured to connect the second member to the first feeding unit so that, when the first member forms a magnetic field in a near field, the second member forms an electric field.

The first and second members may operate as radiators of a dipole antenna.

The antenna module may include a third member disposed between the first and second members; and a second feeding unit configured to feed the third member.

The first and second members may resonate at a first frequency, and the third member may resonate at a second frequency higher than the first frequency.

The antenna module may further include a blocking unit formed between the first feeding unit and the first and second members to block the first and second members from resonating at a harmonic frequency.

The third member may be configured to resonate in a frequency band that the blocking unit blocks.

The first to third members may be formed on one carrier having a predetermined dielectric constant.

The antenna module may further include a resonance unit formed between the third member and the second feeding unit so that the third member additionally resonates at a third frequency adjacent to the second frequency.

The resonance unit may include a shunt capacitor configured to form the third frequency together with the third member.

A matching unit for matching impedance may be formed between the first member and the first feeding unit or between the second member and the first feeding unit. The matching unit may be configured with at least one lumped element.

A T matching unit including three inductors connected to one another at one branch point may be connected to at least one of the first and second members so as to intensify the magnetic field in the near field.

To achieve these and other advantages and in accordance with the purpose of the present disclosure, as embodied and broadly described herein, there is provided a mobile terminal including: a terminal body; and an antenna module mounted in the terminal body, the antenna module operating at a first frequency and a second frequency, wherein the antenna module includes: a first member and a second member fed by a first feeding unit to resonate at the first frequency; and a third member disposed between the first and second members, the third member being fed by a second feeding unit to operate independently, the third member transmitting/receiving radio signals at the second frequency higher than the first frequency.

A matching unit for matching impedance may be formed between the first member and the first feeding unit or between the second member and the first feeding unit. The matching unit may be configured with at least one lumped element.

The antenna module may further include a transmission line configured to connect the second member to the first feeding unit so that, when the first member forms a magnetic field in a near field, the second member forms an electric field.

The antenna module may further include a T matching unit connected to the first or second members, the T matching unit including three inductors connected to one another at one branch point so as to intensify the magnetic field in the near field.

The antenna module may further include a blocking unit configured to block the first and second members from resonating at a harmonic frequency. The second frequency may be included in a frequency band that the blocking unit blocks.

The first and second members may operate as radiators of a dipole antenna.

The antenna module may further include a resonance unit formed between the third member and the second feeding unit so that the third member additionally resonates at a third frequency adjacent to the second frequency.

The resonance unit may include a shunt capacitor configured to form the third frequency together with the third member.

The first and second members may be formed on one carrier having a predetermined dielectric constant.

The carrier may be formed in a predetermined width to be contacted with both side surfaces of the terminal body.

A circuit board may be disposed below the carrier, and the third member may be formed on the circuit board.

The first and second members may be connected to a first communication chip formed on the circuit board, and the third member may be connected to a second communication chip formed on the circuit board.

In the mobile terminal according to at least one embodiment of the present disclosure, it is possible to more efficiently implement antenna devices in a small space and maintain the performance of the antenna devices. Thus, the mobile terminal can become more compact.

In the mobile terminal according to at least one embodiment of the present disclosure, two or more antenna devices can be complexly formed in one antenna module, and each antenna device can maintain performance more than a predetermined level.

DETAILED DESCRIPTION OF THE EMBODIMENTS

Description will now be given in detail of the exemplary embodiments, with reference to the accompanying drawings. For the sake of brief description with reference to the drawings, the same or equivalent components will be provided with the same reference numbers, and description thereof will not be repeated. Hereinafter, a mobile terminal of the present disclosure will be explained in more detail with reference to the attached drawings. The suffixes "module" and "unit or portion" for components used in the following description merely provided only for facilitation of preparing this specification, and thus they are not granted a specific meaning or function. In addition, when it is determined that a detailed description of a technology known in the related art prevents the nature and gist of the present invention from being made apparent, the detailed description of the technology is omitted. In addition, the accompanying drawings are only for helping get an easy understanding of the idea of the present invention and notably, should not be construed as imposing any limitation on the idea of the invention.

The mobile terminal according to the present invention may include a portable phone, a smart phone, a laptop computer, a digital broadcasting terminal, Personal Digital Assistants (PDA), Portable Multimedia Player (PMP), a navigation system, etc. However, it will be obvious to those skilled in the art that the present invention may be also applicable to a fixed terminal such as a digital TV and a desktop computer.

Figure 1:
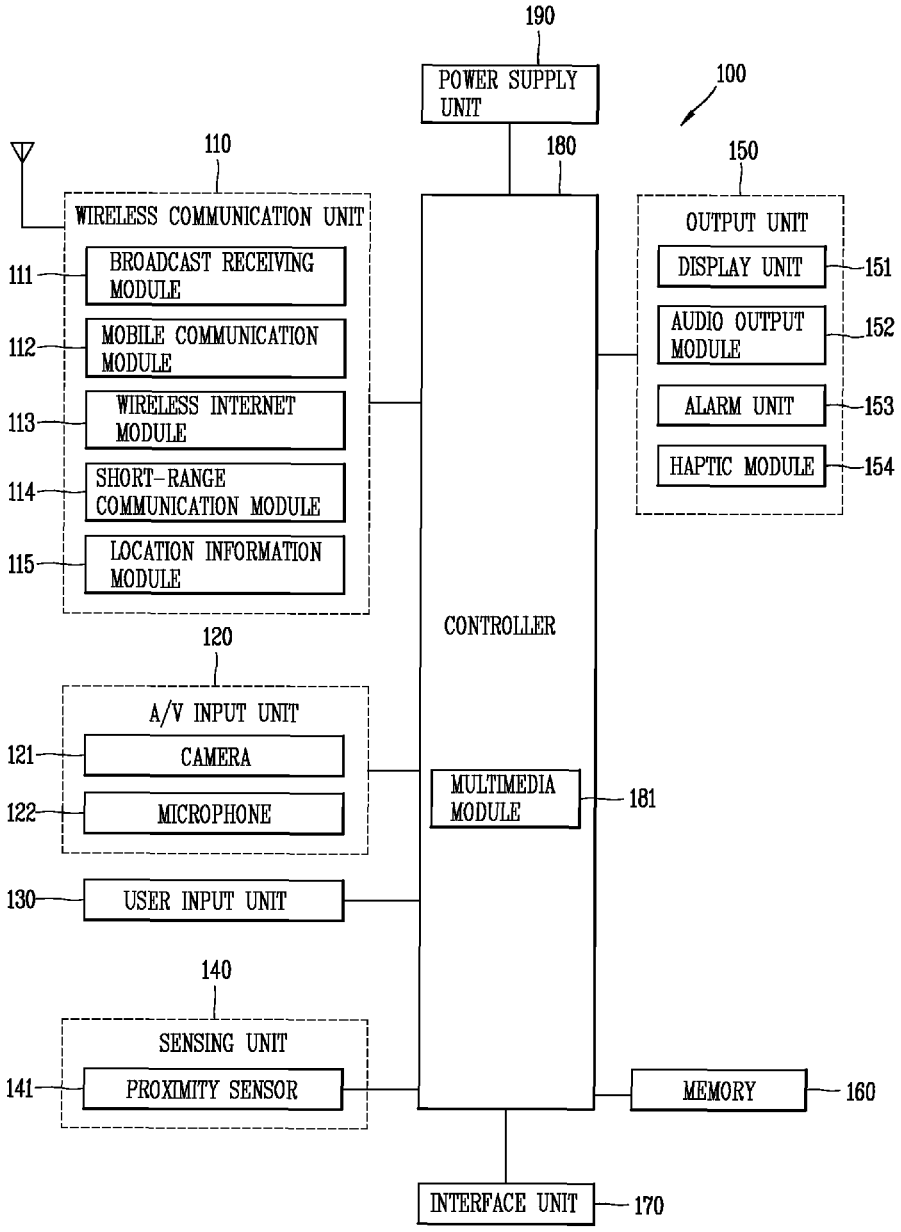
FIG. 1 is a block configuration diagram of a mobile terminal according to an embodiment of the present disclosure.

FIG. 1 is a block diagram of a mobile terminal according to an embodiment of the present invention.

The mobile terminal 100 may comprise components, such as a wireless communication unit 110, an Audio/Video (A/V) input unit 120, a user input unit 130, a sensing unit 140, an output module 150, a memory 160, an interface unit 170, a controller 180, a power supply unit 190, and the like. FIG. 1 shows the mobile terminal 100 having various components, but it is understood that implementing all of the illustrated components is not a requirement. Greater or fewer components may alternatively be implemented.

Hereinafter, each component is described in sequence.

The wireless communication unit 110 may typically include one or more components which permit wireless communications between the mobile terminal 100 and a wireless communication system or between the mobile terminal 100 and a network within which the mobile terminal 100 is located. For example, the wireless communication unit 110 may include a broadcast receiving module 111, a mobile communication module 112, a wireless internet module 113, a short-range communication module 114, a position information module 115 and the like.

The broadcast receiving module 111 receives broadcast signals and/or broadcast associated information from an external broadcast management server (or other network entity) via a broadcast channel.

The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal. The broadcast associated information may refer to information associated with a broadcast channel, a broadcast program or a broadcast service provider. The broadcast signal may include a TV broadcast signal, a radio broadcast signal, a data broadcast signal, and the like. Also, the broadcast signal may further include a broadcast signal combined with a TV or radio broadcast signal.

The broadcast associated information may also be provided via a mobile communication network and, in this case, the broadcast associated information may be received by the mobile communication module 112.

The broadcast signal may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may be configured to receive signals broadcast by using various types of broadcast systems. In particular, the broadcast receiving module 111 may receive a digital broadcast by using a digital broadcast system such as multimedia broadcasting-terrestrial (DMB-T), digital multimedia broadcasting-satellite (DMB-S), digital video broadcast-handheld (DVB-H), the data broadcasting system known as media forward link only (MediaFLO®), integrated services digital broadcast-terrestrial (ISDB-T), etc. The broadcast receiving module 111 may be configured to be suitable for every broadcast system that provides a broadcast signal as well as the above-mentioned digital broadcast systems.

Broadcasting signals and/or broadcasting associated information received through the broadcast receiving module 111 may be stored in the memory 160.

The mobile communication module 112 transmits/receives wireless signals to/from at least one of network entities (e.g., base station, an external terminal, a server, etc.) on a mobile communication network. Here, the wireless signals may include audio call signal, video call signal, or various formats of data according to transmission/reception of text/multimedia messages.

The mobile communication module 112 is configured to implement a video call mode and a voice call mode. The video call mode indicates a call performed while a user views counterpart, whereas the voice call mode indicates a call performed while a user does not view counterpart. For implementation of the video call mode and the voice call mode, the mobile communication module 112 is configured to transmit and receive at least one of voice data and image data.

The wireless internet module 113 supports wireless Internet access for the mobile terminal. This module may be internally or externally coupled to the mobile terminal 100. Examples of such wireless Internet access may include Wireless LAN (WLAN) (Wi-Fi), Wireless Broadband (Wibro), World Interoperability for Microwave Access (Wimax), High Speed Downlink Packet Access (HSDPA), and the like.

The short-range communication module 114 denotes a module for short-range communications. Suitable technologies for implementing this module may include BLUETOOTH, Radio Frequency IDentification (RFID), Infrared Data Association (IrDA), Ultra-WideBand (UWB), ZigBee, and the like.

The position information module 115 denotes a module for sensing or calculating a position of a mobile terminal. An example of the position information module 115 may include a Global Position System (GPS) module.

Referring to FIG. 1, the A/V input unit 120 is configured to receive an audio or video signal. The A/V input unit 120 may include a camera 121, a microphone 122 or the like. The camera 121 processes image frames such as still images or moving images acquired by an image sensor in a video call mode or an image capturing mode. The processed image frames may be displayed on a display unit 151.

The image frames processed by the camera 121 may be stored in the memory 160 or transmitted to the outside via the wireless communication unit 110. Two or more cameras 121 may be provided according to the configuration of the mobile terminal.

The microphone 122 may receive sounds (audible data) via a microphone in a phone call mode, a recording mode, a voice recognition mode, and the like, and can process such sounds into audio data. The processed audio (voice) data may be converted for output into a format transmittable to a mobile communication base station via the mobile communication module 112 in case of the phone call mode. The microphone 122 may implement various types of noise canceling (or suppression) algorithms to cancel (or suppress) noise or interference generated while receiving and transmitting audio signals.

The user input unit 130 may generate input data for allowing a user to control various operations of the mobile communication terminal. The user input unit 130 may include a keypad, a dome switch, a touch pad (e.g., a touch sensitive member that detects changes in resistance, pressure, capacitance, etc. due to being contacted) a jog wheel, a jog switch, and the like.

The sensing unit 140 detects a current status (or state) of the mobile terminal 100 such as an opened or closed state of the mobile terminal 100, a location of the mobile terminal 100, the presence or absence of user contact with the mobile terminal 100 (e.g., touch inputs), the orientation of the mobile terminal 100, an acceleration or deceleration movement and direction of the mobile terminal 100, etc., and generates commands or signals for controlling the operation of the mobile terminal 100. For example, when the mobile terminal 100 is implemented as a slide type mobile phone, the sensing unit 140 may sense whether the slide phone is open or closed. In addition, the sensing unit 140 can detect whether or not the power supply unit 190 supplies power or whether or not the interface unit 170 is coupled with an external device.

The output unit 150 is configured to provide outputs in a visual, audible, and/or tactile manner. The output unit 150 may include the display unit 151, an audio output module 153, an alarm unit 154, a haptic module 155, and the like.

The display unit 151 may display information processed in the mobile terminal 100. For example, when the mobile terminal 100 is in a phone call mode, the display unit 151 may display a User Interface (UI) or a Graphic User Interface (GUI) associated with a call. When the mobile terminal 100 is in a video call mode or image capturing mode, the display unit 151 may display a captured image and/or received image, or a UI or GUI.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, and an e-ink display.

Some of these displays may be configured to be transparent so that outside may be seen therethrough, which may be referred to as a transparent display. A representative example of the transparent display may include a Transparent Organic Light Emitting Diode (TOLED), and the like. The rear surface portion of the display unit 151 may also be implemented to be optically transparent. Under this configuration, a user can view an object positioned at a rear side of a body through a region occupied by the display unit 151 of the body.

The display unit 151 may be implemented in two or more in number according to a configured aspect of the mobile terminal 100. For instance, a plurality of displays may be arranged on one surface integrally or separately, or may be arranged on different surfaces.

If the display unit 151 and a touch sensitive sensor (referred to as a touch sensor) have a layered structure therebetween, the structure may be referred to as a touch screen. The display unit 151 may be used as an input device rather than an output device. The touch sensor may be implemented as a touch film, a touch sheet, a touch pad, and the like.

The touch sensor may be configured to convert changes of a pressure applied to a specific part of the display unit 151, or capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller (not shown). The touch controller processes the received signals, and then transmits corresponding data to the controller 180. Accordingly, the controller 180 may sense which region of the display unit 151 has been touched.

Referring to FIG. 1, a proximity sensor 141 may be arranged at an inner region of the mobile terminal blocked by the touch screen, or near the touch screen. The proximity sensor 141 indicates a sensor to sense presence or absence of an object approaching to a surface to be sensed, or an object disposed near a surface to be sensed, by using an electromagnetic field or infrared rays without a mechanical contact. The proximity sensor 141 has a longer lifespan and a more enhanced utility than a contact sensor.

The proximity sensor 141 may include a transmissive type photoelectric sensor, a direct reflective type photoelectric sensor, a mirror reflective type photoelectric sensor, a high-frequency oscillation proximity sensor, capacitance type proximity sensor, a magnetic type proximity sensor, an infrared rays proximity sensor, and so on. When the touch screen is implemented as capacitance type, proximity of a pointer to the touch screen is sensed by changes of an electromagnetic field. In this case, the touch screen (touch sensor) may be categorized into the proximity sensor.

Hereinafter, for the sake of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position corresponds to a position where the pointer faces perpendicular to the touch screen upon the proximity touch of the pointer.

The proximity sensor 141 senses proximity touch, and proximity touch patterns (e.g., distance, direction, speed, time, position, moving status, etc.). Information relating to the sensed proximity touch and the sensed proximity touch patterns may be output onto the touch screen.

The audio output module 152 may convert and output as sound audio data received from the wireless communication unit 110 or stored in the memory 160 in a call signal reception mode, a call mode, a record mode, a voice recognition mode, a broadcast reception mode, and the like. Also, the audio output module 152 may provide audible outputs related to a particular function performed by the mobile terminal 100 (e.g., a call signal reception sound, a message reception sound, etc.). The audio output module 152 may include a speaker, a buzzer or the like.

The alarm unit 153 outputs a signal for informing about an occurrence of an event of the mobile terminal 100. Events generated in the mobile terminal may include call signal reception, message reception, key signal inputs, a touch input etc. In addition to video or audio signals, the alarm unit 153 may output signals in a different manner, for example, using vibration to inform about an occurrence of an event. The video or audio signals may be also outputted via the audio output module 152, so the display unit 151 and the audio output module 152 may be classified as parts of the alarm unit 153.

A haptic module 154 generates various tactile effects the user may feel. A typical example of the tactile effects generated by the haptic module 155 is vibration. The strength and pattern of the haptic module 154 can be controlled. For example, different vibrations may be combined to be outputted or sequentially outputted.

Besides vibration, the haptic module 154 may generate various other tactile effects such as an effect by stimulation such as a pin arrangement vertically moving with respect to a contact skin, a spray force or suction force of air through a jet orifice or a suction opening, a contact on the skin, a contact of an electrode, electrostatic force, etc., an effect by reproducing the sense of cold and warmth using an element that can absorb or generate heat.

The haptic module 154 may be implemented to allow the user to feel a tactile effect through a muscle sensation such as fingers or arm of the user, as well as transferring the tactile effect through a direct contact. Two or more haptic modules 154 may be provided according to the configuration of the mobile terminal 100.

The memory 160 may store software programs used for the processing and controlling operations performed by the controller 180, or may temporarily store data (e.g., a phonebook, messages, still images, video, etc.) that are inputted or outputted. In addition, the memory 160 may store data regarding various patterns of vibrations and audio signals outputted when a touch is inputted to the touch screen.

The memory 160 may include at least one type of storage medium including a Flash memory, a hard disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, and an optical disk. Also, the mobile terminal 100 may be operated in relation to a web storage device that performs the storage function of the memory 160 over the Internet.

The interface unit 170 serves as an interface with every external device connected with the mobile terminal 100. For example, the external devices may transmit data to an external device, receives and transmits power to each element of the mobile terminal 100, or transmits internal data of the mobile terminal 100 to an external device. For example, the interface unit 170 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating the authority of using the mobile terminal 100 and may include a user identity module (UIM), a subscriber identity module (SIM) a universal subscriber identity module (USIM), and the like. In addition, the device having the identification module (referred to as 'identifying device', hereinafter) may take the form of a smart card. Accordingly, the identifying device may be connected with the terminal 100 via the interface unit 170.

When the mobile terminal 100 is connected with an external cradle, the interface unit 170 may serve as a passage to allow power from the cradle to be supplied therethrough to the mobile terminal 100 or may serve as a passage to allow various command signals inputted by the user from the cradle to be transferred to the mobile terminal therethrough. Various command signals or power inputted from the cradle may operate as signals for recognizing that the mobile terminal is properly mounted on the cradle.

The controller 180 typically controls the general operations of the mobile terminal. For example, the controller 180 performs controlling and processing associated with voice calls, data communications, video calls, and the like. The controller 180 may include a multimedia module 181 for reproducing multimedia data. The multimedia module 181 may be configured within the controller 180 or may be configured to be separated from the controller 180.

The controller 180 may perform a pattern recognition processing to recognize a handwriting input or a picture drawing input performed on the touch screen as characters or images, respectively.

Also, the controller 180 may execute a lock state to restrict a user from inputting control commands for applications when a state of the mobile terminal meets a preset condition. Also, the controller 180 may control a lock screen displayed in the lock state based on a touch input sensed on the display unit 151 in the lock state of the mobile terminal.

The power supply unit 190 receives external power or internal power and supplies appropriate power required for operating respective elements and components under the control of the controller 180.

Various embodiments described herein may be implemented in a computer-readable or its similar medium using, for example, software, hardware, or any combination thereof.

For hardware implementation, the embodiments described herein may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic units designed to perform the functions described herein. In some cases, such embodiments may be implemented by the controller 180 itself.

For software implementation, the embodiments such as procedures or functions described herein may be implemented by separate software modules. Each software module may perform one or more functions or operations described herein.

Software codes can be implemented by a software application written in any suitable programming language. The software codes may be stored in the memory 160 and executed by the controller 180.

Figure 2:
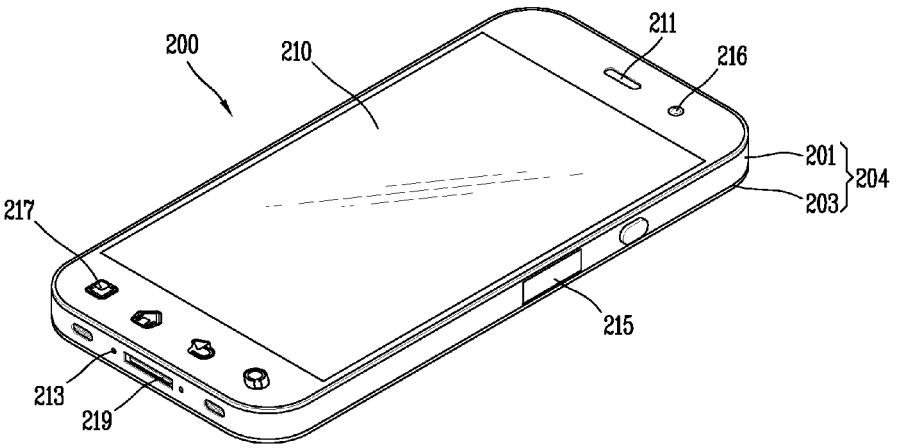
FIG. 2 is a front perspective view of a mobile terminal according to an embodiment of the present disclosure.
Figure 3:
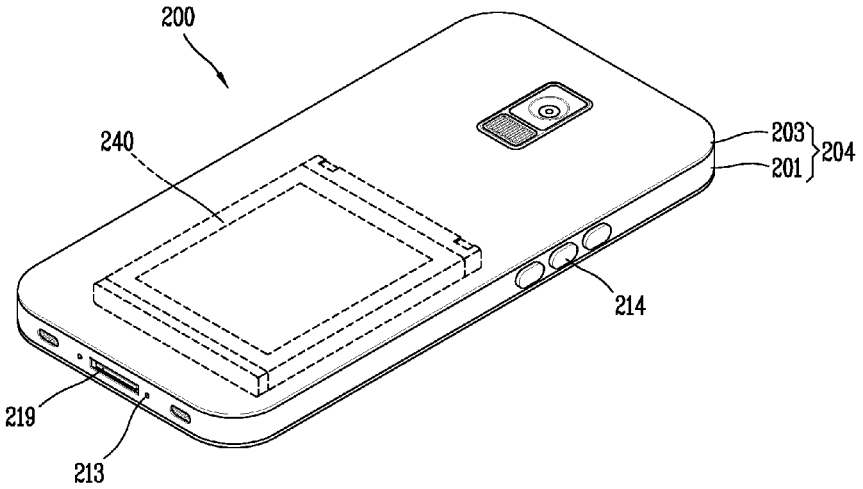
FIG. 3 is a rear perspective view of the mobile terminal of FIG. 2.

FIG. 2 is a front perspective view of a mobile terminal according to the present invention, and FIG. 3 is a rear perspective view of the mobile terminal of FIG. 2.

Referring to FIGS. 2 and 3, the mobile terminal 200 according to the present invention is provided with a bar type terminal body 204. However, the present invention is not limited to this, but may be applied to a slide type in which two or more bodies are coupled to each other so as to perform a relative motion, a folder type, a swing type, and the like. Further, the mobile terminal of the present invention may be applied to any portable electronic device having a camera and a flash, for instance, a portable phone, a smart phone, a notebook computer, a digital broadcasting terminal, Personal Digital Assistants (PDAs), Portable Multimedia Players (PMO), etc.

The mobile terminal 200 includes a terminal body 204 which forms the appearance thereof.

A case (casing, housing, cover, etc.) which forms the appearance of the terminal body 204 may include a front case 201, a rear case 202, and a battery cover 203 for covering the rear surface of the rear case 202.

A space formed by the front case 201 and the rear case 202 may accommodate various components therein. Such cases may be formed by injection-molded synthetic resin, or may be formed using a metallic material such as stainless steel (STS) or titanium (Ti).

On the front surface of the terminal body 204, may be disposed a display unit 210, a first audio output unit 211, a front camera 216, a side key 214, an interface unit 215, and a signal input unit 217.

The display unit 210 includes a liquid crystal display (LCD) module, organic light emitting diodes (OLED) module, e-paper, etc., each for visually displaying information. The display unit 210 may include a touch sensing means for inputting information in a touch manner. Hereinafter, the display unit 210 including the touch sensing means is called 'touch screen'. Once part on the touch screen 210 is touched, content corresponding to the touched position is input. The content input in a touch manner, may be characters, or numbers, or menu items which can be set in each mode. The touch sensing means may be transmissive so that the display can be viewed, and may include a structure for enhancing visibility of the touch screen at a bright place. Referring to FIG. 2, the touch screen 210 occupies most of the front surface of the front case 201.

The first audio output unit 211 may be implemented as a receiver for transmitting a call sound to a user's ear, or a loud speaker for outputting each type of alarm sound or a playback sound of multimedia.

The front camera 216 processes image frames such as still images or moving images, acquired by an image sensor in a video call mode or a capturing mode. The processed image frames may be displayed on the display unit 210.

The image frames processed by the front camera 216 may be stored in the memory 160, or may be transmitted to the outside through the wireless communication unit 110. The front camera 216 may be implemented in two or more according to a user's interface.

The signal input unit 217 is manipulated to receive a command for controlling the operation of the mobile terminal 200, and may include a plurality of input keys. The input keys may be referred to as manipulation portions, and may include any type of ones that can be manipulated in a user's tactile manner.

For instance, the user input unit 300 may be implemented as a dome switch, or a touch screen, or a touch pad for inputting commands or information in a user's push or touch manner. Alternatively, the user input unit 300 may be implemented, for example, as a wheel for rotating a key, a jog, or a joystick. The user input unit 300 is configured to input various commands such as START, END and SCROLL.

A side key 214, an interface unit 215, an audio input unit 213, etc. are disposed on the side surface of the front case 201.

The side key 214 may be called 'manipulation unit', and may be configured to receive commands for controlling the operation of the mobile terminal 200. The side key 214 may include any type of ones that can be manipulated in a user's tactile manner. Content input by the side key 214 may be variously set. For instance, through the side key 214, may be input commands such as controlling the front and rear cameras 216 and 221, controlling the level of sound output from the audio output unit 211, and converting a current mode of the display unit 210 into a touch recognition mode.

The audio output unit 213 may be implemented as a microphone for receiving a user's voice, other sound, etc.

The interface unit 215 serves a path through which the mobile terminal 200 performs data exchange, etc. with an external device. For example, the interface unit 215 may be at least one of a connection terminal through which the mobile terminal 200 is connected to an ear phone by cable or radio, a port for local area communication, e.g., an infrared data association (IrDA) port, a Bluetooth portion, a wireless LAN port, and power supply terminals for supplying power to the mobile terminal 200. The interface unit 215 may be a card socket for accommodating an external card such as a subscriber identification module (SIM) card, a user identity module (UIM) card or a memory card for storing information.

A power supply unit 240 and the rear camera 221 are disposed on the rear surface of the body 204.

A flash 222 and a mirror (not shown) may be disposed close to the rear camera 221. When capturing an object by using the rear camera 221, the flash 222 provides light onto the object.

When the user captures an image of himself/herself by using the rear camera 221, the mirror can be used for the user to look at himself/herself therein.

The rear camera 221 may face a direction which is opposite to a direction faced by the front camera 216, and may have different pixels from those of the front camera 216.

For example, the front camera 216 may operate with relatively lower pixels (lower resolution). Thus, the front camera 216 may be useful when a user can capture his face and send it to another party during a video call or the like. On the other hand, the rear camera 221 may operate with a relatively higher pixels (higher resolution) such that it can be useful for a user to obtain higher quality pictures for later use. The front camera 216 and the rear camera 221 may be installed at the terminal body 204 so as to rotate or pop-up.

The power supply unit 240 is configured to supply power to the mobile terminal 200. The power supply unit 240 may be mounted in the terminal body 204, or may be detachably mounted to the terminal body 204.

Figure 4:
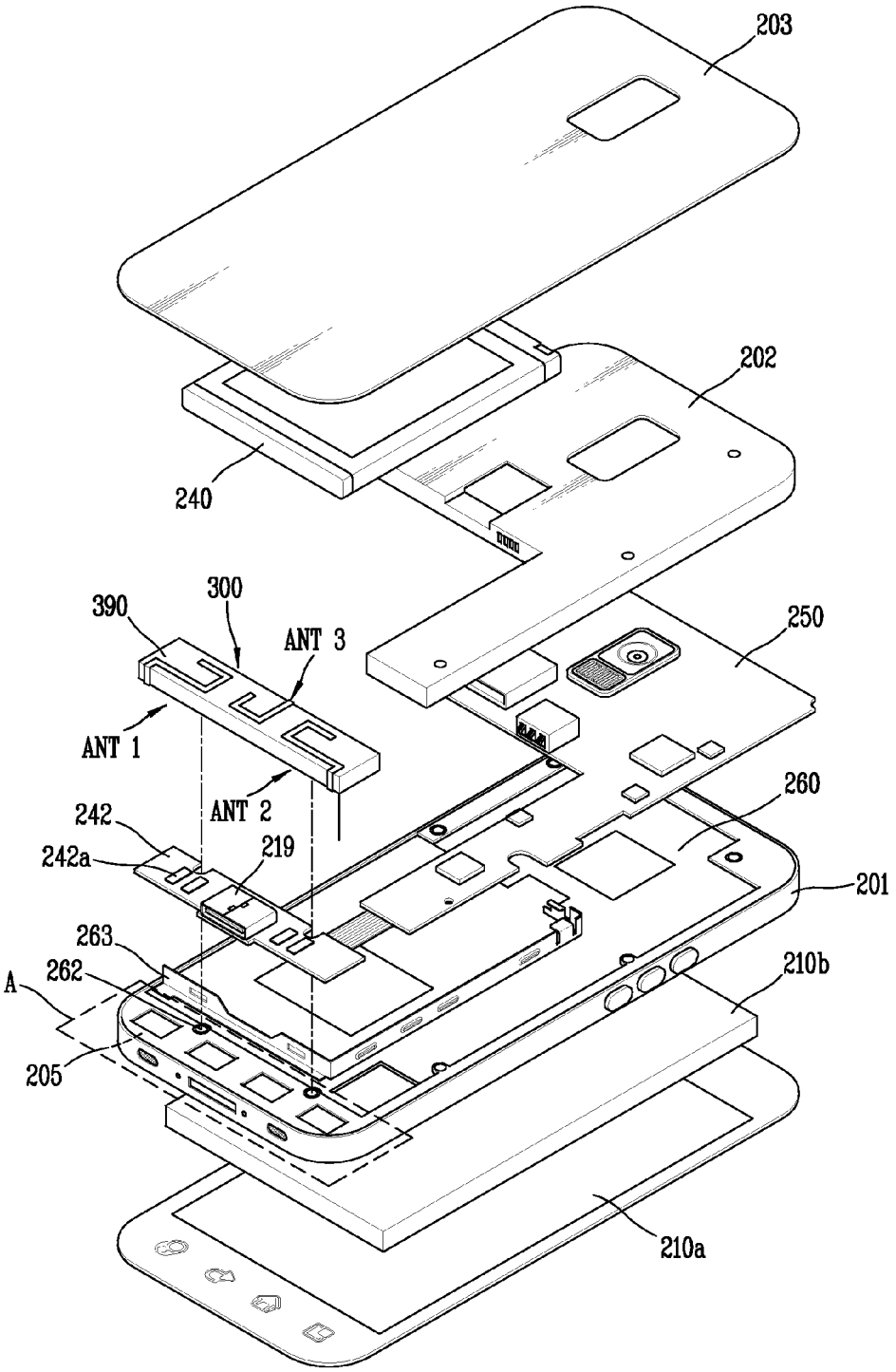
FIG. 4 is an exploded perspective view of FIG. 3.

FIG. 4 is an exploded perspective view of FIG. 3.

Referring to FIG. 4, the mobile terminal includes a window 210*a* and a display module 210*b*, which constitute the display unit 210. The window 210*a* may be coupled to one surface of the front case 201. The window 210*a* and the display module 210*b* may be formed in a single body.

A frame 260 configured to support electric devices is formed between the front case 201 and a rear case 202. The frame 260 is a structure for supporting the inside of the mobile terminal. For example, the frame 260 may be configured to support at least one of the display module 210*b*, a camera module, an antenna device, an antenna module having a plurality of antenna devices, a battery 240, and a circuit board 250.

The frame 260 may have a portion exposed to the outside of the mobile terminal. The frame 260 may constitute a portion of a sliding module which connects a body portion and a display portion to each other in a slide type mobile terminal rather than a bar type mobile terminal.

As an example, in FIG. 4, the circuit board 250 may be disposed between the frame 260 and the rear case 202, and the display module 210*b* may be coupled to one surface of the frame 260. The circuit board 250 and the battery 240 may be disposed on another surface of the frame 260, and the battery case 203 may be coupled to the rear case 202 to cover the battery 240.

The window 210*a* is coupled to one surface of the front case 201. A touch sensing pattern for sensing a touch input may be formed on one surface of the window 210*a*. The touch sensing pattern is configured to sense a touch input, and is formed of a transmissive material. The touch sensing pattern may be mounted to a front surface of the window 210*a*, and may be configured to convert a change in voltage or the like, which occurs at a specific portion of the window 210*a*, into an electric input signal.

The display module 210*b* is mounted to a rear surface of the window 210*a*. In this embodiment, a thin film transistor-liquid crystal display (TFT LCD) is exemplified as the display module 210*b*. However, the present disclosure is not limited thereto.

Examples of the display module 210*b* may be a liquid crystal display (LCD), an organic light-emitting diode (OLED), a flexible display, a 3-dimensional (3D) display, and the like.

The circuit board 250, as described above, may be formed on one surface of the frame 260. However, the circuit board 250 may be formed below the display module 210*b*. At least one electronic device may be mounted on a lower surface of the circuit board 250.

An accommodating portion recessed to accommodate the battery 240 therein is formed in the frame 260. A contact terminal may be formed on one side surface of the accommodating portion. The contact terminal is connected to the circuit board 250 so that the battery 240 can supply power to a terminal body.

An antenna device may be formed at an upper or lower end of the mobile terminal. The antenna device may be formed in plurality, and the plurality of antenna devices may be disposed at the ends of the mobile terminal, respectively. In this case, the antenna devices may be configured to transmit/receive radio signals in different frequency bands. The antenna devices may include conductive members formed on one surface of a carrier. For example, a carrier 390 having conductive members formed thereon may be mounted to portion A shown in FIG. 4. The carrier 390 may be coupled to the portion A of the case 201 by fastening means such as screws. In this case, the screw may be coupled to a hole 262 of the case 201 by passing through a through-hole of the carrier 390. A rib 263 of the frame 260 to be described later may define a space in which the carrier 390 is mounted.

The frame 260 may be made of a metallic material so as to have a sufficient strength even in a small thickness. The frame 260 made of the metallic material may operate as a ground. That is, the circuit board 250 or the antenna device may be ground-connected to the frame 260, and the frame 260 may operate as a ground of the circuit board 250 or the antenna device. In this case, the frame 260 may extend a ground of the mobile terminal.

The circuit board 250 is electrically connected to the antenna device, and is configured to process radio signals (or radio electromagnetic waves) transmitted/received by the antenna device. For processing of radio signals, a plurality of transceiver circuits may be formed or mounted on the circuit board 250.

The transceiver circuits may include one or more integrated circuits and related electric devices. As an example, the transceiver circuit may include a transmission integrated circuit, a reception integrated circuit, a switching circuit, an amplifier, and the like.

As the plurality of transceiver circuits simultaneously feed conductive members formed as conductive patterns that are radiators, a plurality of antenna devices may simultaneously operate. For example, while one of the transceiver circuits performs signal transmission, another transceiver circuit may perform signal reception. Alternatively, both of the transceiver circuits may perform signal transmission or signal reception.

A coaxial cable may be formed to connect the circuit board 250 and each antenna device to each other. For example, the coaxial cable may be connected to feeding devices for feeding antenna devices. The feeding devices may be formed on one surface of a flexible circuit board 242 for processing signals input from the manipulating portion 217. Another surface of the flexible circuit board 242 may be coupled to a signal transmission unit for transmitting signals of the manipulating portion 217. In this case, a dome may be formed on another surface of the flexible circuit board 242, and an actuator may be formed at the signal transmission unit.

Antenna devices ANT 1 and ANT 2 may be formed at one and another sides of the carrier 390, respectively. The antenna devices ANT 1 and ANT 2 are configured to transmit/receive signals in different frequency bands.

For example, a first antenna device ANT 1 may be configured to transmit/receive DCN 1× type or PCS 1× type signals, and a second antenna device ANT 2 may be configured to transmit and receive DCN evolution-data optimized or evolution-data only (EVDO) type signals.

If the first antenna device ANT 1 transmits/receives LTE B4 type signals, the second antenna device ANT 2 may be configured to transmit/receive LTE B13 type signals.

Alternatively, if the first antenna device ANT 1 transmits/receives signals corresponding to voice service of the mobile terminal, the second antenna device ANT 2 may be configured to transmit/receive signals corresponding to LTE service of the mobile terminal.

The flexible circuit board 242 is connected to a lower portion of the carrier 390. One end of the flexible circuit board 242 may be connected to the circuit board 250 having a controller. The flexible circuit board 242 may be connected to the manipulating portion 217 of the mobile terminal. In this case, the flexible circuit board 242 is formed so that a signal generated from the manipulating portion 217 can be transmitted to the controller of the circuit board 250. For example, the flexible circuit board 242 may be formed below the manipulating portion 217 so as to be connected to the manipulating portion 217. The flexible circuit board 242 may be formed so as to be contacted with a signal transmission portion disposed between the manipulating portion 217 and the flexible circuit board 242.

One surface of the flexible circuit board 242 may be formed so as to be contacted with the manipulating portion 217, and contact portions 242*a* may be formed on another surface of the flexible circuit board 242 so as to be respectively connected to feeding connection portions F and ground connection portions G of the first and second antenna devices ANT 1 and ANT 2.

Figure 5:
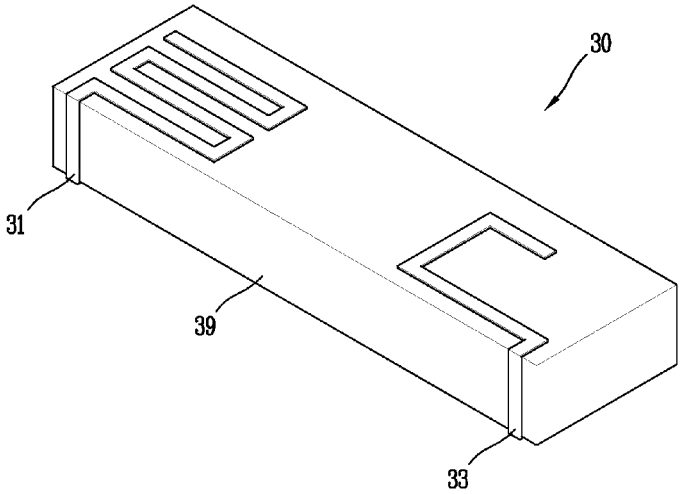
FIG. 5 is a perspective view of an antenna module according to a comparative example.
Figure 6:
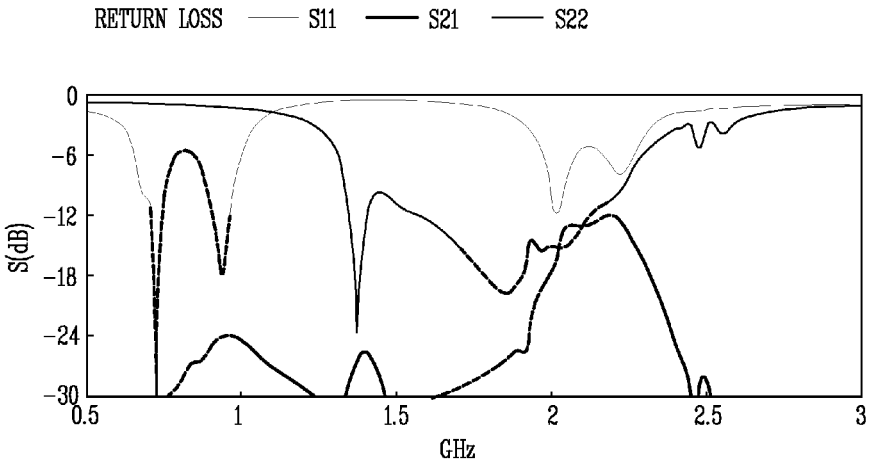
FIG. 6 is a view illustrating reflection coefficients with respect to frequencies in the antenna module shown in FIG. 5.

FIG. 5 is a perspective view of an antenna module according to a comparative example. FIG. 6 is a view illustrating reflection coefficients with respect to frequencies in the antenna module shown in FIG. 5.

In order to install a plurality of antennas in a smaller space, a plurality of antenna devices may be implemented in one antenna module. In the comparative example, first and second antenna devices ANT 1 and ANT 2 are formed on one carrier.

Referring to FIG. 5, the antenna module 30 according to the comparative example includes a first member 31 and a second member 32. The first and second members 31 and 32 may act as radiators of the first and second antenna devices ANT 1 and ANT 2, respectively. The first and second members 31 and 32 are disposed adjacent to each other, and each member is configured to resonate at a predetermined frequency. That is, the first member 31 may be formed in a predetermined length to resonate at a first frequency, and the second member 32 may be formed in a predetermined length to resonate at a second frequency. Here, the first frequency is a low frequency, and the second frequency may be a frequency higher than the first frequency. The first and second members 31 and 32 may be formed to have lengths of about $\lambda/4$, corresponding to the first and second frequencies, respectively.

The first and second members 31 and 32 may be formed as conductive patterns printed on one surface of the carrier 39.

Referring to FIG. 6, it can be seen that the first antenna device including the first member, as shown through S11, resonates at 500 MHz and 900 MHz, and again resonates at a frequency band of about 2 GHz that is a harmonic frequency. Also, it can be seen that the second antenna device including the second member, as shown through S22, resonates in a frequency band of about 2 GHz.

In this instance, the isolation characteristic between the antenna devices can be seen through S22. The isolation degree of the second antenna device is −15 dB or less due to interference caused by the harmonic frequency of the first antenna device. That is, if the first and second antenna devices are formed adjacent to each other in one antenna module, the antenna performance of the second antenna device in a high frequency band may be degraded.

Accordingly, examples of the configuration of an antenna which can prevent degradation of antenna performance when a plurality of antenna devices are formed in one antenna module will be described below with reference to the accompanying drawings.

Figure 7:
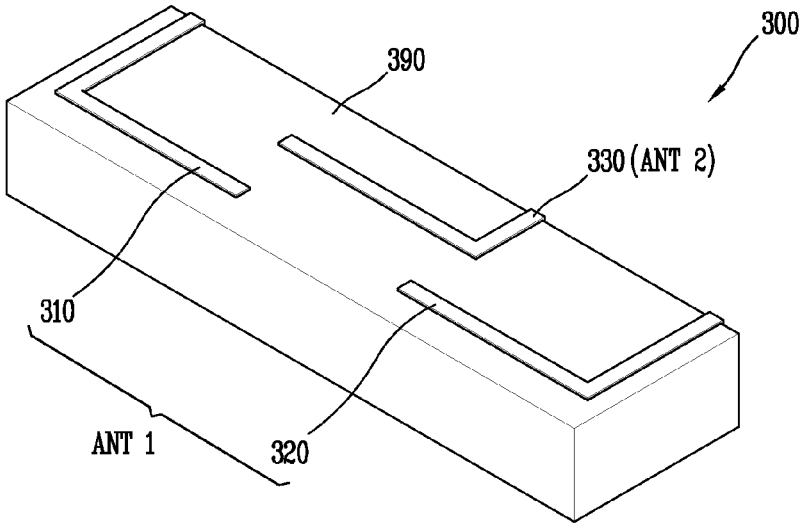
FIG. 7 is a perspective view of an antenna module according to an embodiment of the present disclosure.
Figure 8A:
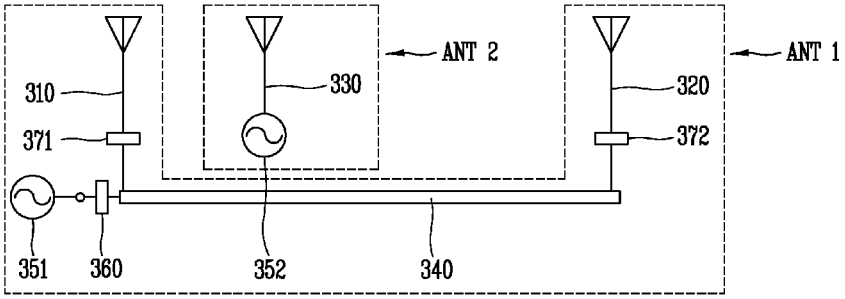
FIG. 8A is a conceptual diagram of the antenna module shown in FIG. 7.
Figure 8B:
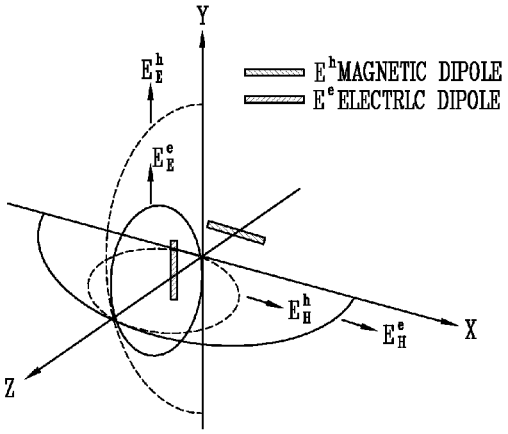
FIG. 8B is a conceptual diagram illustrating an example in which magnetic and electric fields interact with each other in a near field.
Figure 8C:
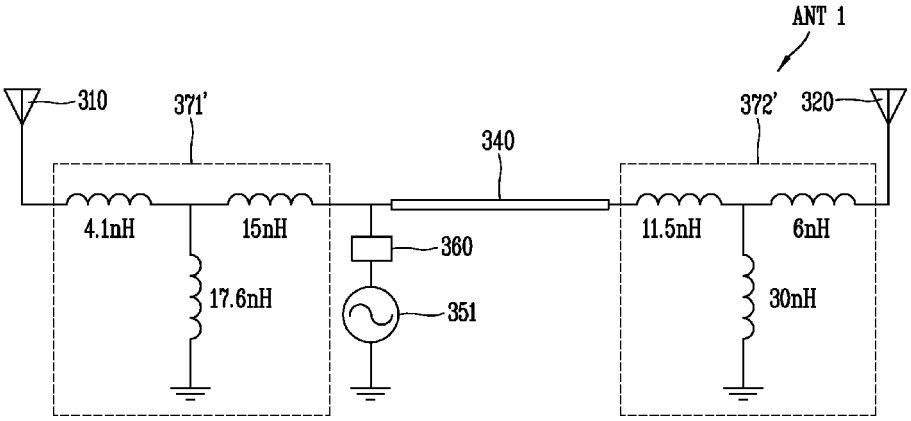
FIG. 8C is a conceptual diagram illustrating an example of a matching unit.

FIG. 7 is a perspective view of an antenna module according to an embodiment of the present disclosure. FIG. 8A is a conceptual diagram of the antenna module shown in FIG. 7. FIG. 8B is a conceptual diagram illustrating an example in which magnetic and electric fields interact with each other in a near field. FIG. 8C is a conceptual diagram illustrating an example of a matching unit.

The antenna module 300 according to the embodiment of the present disclosure may be mounted in the mobile terminal to form a portion of a system for providing long term evolution (LTE) communication services. Thus, the antenna module 300 can include a plurality of antenna devices for respectively transmitting or receiving corresponding radio signals, to perform carrier aggregation in an LTE band.

In order to perform the carrier aggregation, each antenna device formed in the antenna module 300 may operate as MIMO or diversity.

Referring to FIGS. 7 and 8A, the antenna module 300 according to the embodiment of the present disclosure includes a first member 310 and a second member 320. The first and second members 320 may operate together as radiators of a first antenna device ANT 1. In this case, the first and second members may operate as radiators of a dipole antenna.

The first antenna device ANT 1 of the present disclosure is an antenna using a magneto electric effect. The magneto electric effect refers to a phenomenon that magnetization is generated in proportion to an electric field when the electric field is applied to an object or a phenomenon that electric polarization is generated in proportion to a magnetic field when the magnetic field is applied to an object.

Referring to FIGS. 8A and 8B, the first antenna device ANT 1 of the present disclosure may be configured so that when the first member 310 forms a magnetic field in a near field, the second member 320 forms an electric field. On the contrary, the first antenna device ANT 1 of the present disclosure may be configured so that when the first member 310 forms an electric field in the near field, when the second member 320 forms a magnetic field. Here, that each of the first and second members 310 and 320 forms a magnetic or electric field does not means that any member forms only a magnetic or electric field but means that, through an input, the first member 310 forms a magnetic field having an intensity greater than that of an electric field and the second member 320 forms an electric field having an intensity greater than that of a magnetic field.

If magnetic and electric fields are simultaneously formed in the near field, the magnetic and electric fields are intensified while influencing each other due to the magneto electric effect. Accordingly, the intensity of radiated signals is enhanced, thereby improving the efficiency and bandwidth of the antenna.

Referring back to FIGS. 8A and 8C, a T matching unit 371' or 372' may be connected to any one member so that the member forms a superior magnetic field. The T matching unit 371' or 372' may include three inductors connected to one another at one branch point to intensify the magnetic field in the near field. When the member connected to the T matching unit 371' or 372' is fed, the T matching unit 371' or 372' can intensify the magnetic field of the fed member.

As shown in FIGS. 8A and 8C, any one member may be connected to a transmission line 340 so that the member forms a superior electric field. The transmission line 340 refers to a conductor formed to efficiently transmit signals or power between two or more terminals. The transmission line 340 may be formed as a conducting wire, a waveguide, a coaxial cable, or a conductive line on PCB.

That is, if the T matching unit 371' or 372' intensifies the magnetic field formed by the first member 310, the transmission line 340 intensifies the electric field formed by the second member 320, so that the intensity of radiated signals is enhanced due to the magneto electric effect. Thus, the first antenna device ANT 1 can maintain superior antenna performance.

Referring to FIGS. 7 and 8A, the first and second members 310 and 320 may be formed symmetric to each other. Each of the first and second members 310 and 320 may be formed in a predetermined length to resonate at a first frequency. For example, each of the first and second members 310 and 320 may be formed in a length of about $\lambda/4$ corresponding to the first frequency so as to operate as a dipole antenna. In this case, each member may be formed into a structure bent several times or a meander structure so that the members can be formed in a constant length in a limited space.

As shown in FIG. 7, each of the first and second members 310 and 320 is not provided with a separate branch for parasitic resonance. That is, current flows in only one direction from one end to the other end of each of the first and second members 310 and 320. If the flow of current is simple as described above, the electric or magnetic field formed around the antenna has a simple pattern, thereby increasing a user's specific absorption rate (SAR).

Referring to FIGS. 7 and 8A, in the antenna module 300, a third member 330 may be disposed between the first and second members 310 and 320 in order to implement a larger number of antenna devices in a narrow space. The antenna devices modularized as described above can contribute to the miniaturization of the mobile terminal. When the first and second members 310 and 320 resonate at the first frequency, the third member 330 may be configured to resonate at a second frequency higher than the first frequency. That is, the first frequency may be included in a frequency band of about 698 to 900 MHz, which is a low frequency band, and the second frequency may be included in a frequency band of about 1710 to 2170 MHz, which is a high frequency band.

Since the antenna devices are formed in a narrower space, the antenna performance may be degraded due to interference between the antenna devices. Particularly, interference between the first and third members 310 and 330 or interference between the second and third members 320 and 330 may be problematic.

In the present disclosure, as a plan for increasing isolation degree by reducing interference between antennas, a blocking unit 260 is configured to block the first and second members 310 and 320 from resonating at a harmonic frequency. Referring to FIG. 8A, the first and second members 310 and 320 are connected to each other by the transmission line, and the blocking unit 360 is formed between the transmission line 340 and a feeding unit 351.

Referring to FIG. 7, the first and second members 310 and 320 may be formed as conductive patterns printed on one surface of a carrier 390 or be formed on the circuit board 250 of the mobile terminal or a case for forming the external appearance of the mobile terminal. The carrier 390 is a dielectric having a predetermined dielectric constant, and may include FR-3 made of several sheets of paper in which an epoxy resin bonding agent is impregnated, and CEM-1 that is a synthetic body having a paper core in which an epoxy resin is impregnated. The carrier 390 may also include CEM-3 having a surface in which an epoxy resin is impregnated in a woven glass fiber and a core in which an epoxy resin is impregnated in an unwoven glass fiber, FR-4 made of several sheets of glass fiber in which an epoxy resin is impregnated, FR-5 made of several sheets of woven glass fiber in which a multifunctional epoxy resin is impregnated, GI made of several sheets of woven glass fiber in which a polyimide resin is impregnated, and materials identical to some of the materials constituting a printed circuit board PCB.

The carrier 390 including the members 310, 320 and 330 may be formed in a predetermined width to be contacted with both side surfaces of the terminal body. For example, the carrier 390 may be accommodated in the front case so that the front case and the carrier 390 can be contacted with each other.

The antenna module 300 of the present disclosure may be disposed at a lower portion of the terminal body. In this instance, a larger number of antennas can be mounted in a wider space, using the carrier 390 formed in the predetermined width to be contacted with both the side surfaces at the lower portion of the terminal body. The performance of an antenna may be restricted by the space in which the antenna is mounted. However, in the antenna module 300 according to the embodiment of the present disclosure, two antenna devices are formed on one carrier 390, so that it is possible to improve antenna performance while efficiently utilizing a space. Conventionally, two antenna devices were configured as antenna modules by forming the antenna devices respectively at both sides of the carrier 390. However, according to the embodiment of the present disclosure, a second antenna device ANT 2 operating in another frequency band may be additionally formed in addition to the first antenna device ANT 1.

The first and second antenna devices ANT 1 and ANT 2 may have the same characteristic impedance, and the value of the characteristic impedance may be 50 ohms. Therefore, the first antenna device ANT 1 may operate as a dipole antenna and the second antenna device ANT 2 may operate as a monopole antenna.

The blocking unit 360 may be formed with conductive patterns on a board so that the conductive patterns operate as a capacitor and an inductor, respectively. Alternatively, the blocking unit 360 may include one or more lumped elements. An inductor or capacitor may be used as the lumped element.

The blocking unit 360 may block the first antenna device ANT 1 from resonating in a blocking frequency band. Although the first antenna device ANT 1 actually resonates, the blocking unit 360 may block signals generated by the resonance from being input to the mobile terminal or being radiated. If the blocking frequency band is F1 to F2, the blocking unit 360 may be configured to block signals in the band of F1 to F2.

In a case where the blocking unit 360 includes one or more inductors, the blocking unit 360 may block signals corresponding to a frequency higher than F1 in the blocking frequency band (F1 to F2). In a case where the blocking unit 360 includes one or more capacitors, the blocking unit 360 may block signals corresponding to a frequency lower than F2 in the blocking frequency band (F1 to F2). If the blocking unit 360 includes inductors and capacitors combined together, the blocking unit 360 may block the first antenna device ANT 1 from resonating in a specific frequency band.

The blocking unit 360 may include a capacitor, an inductor and a switching element. The switching element may selectively switch between the capacitor and the inductor to connect the capacitor or the inductor to the feeding unit 351 or the transmission line 340. Alternatively, the switching element may simultaneously connect the capacitor and the inductor to the feeding unit 351 or the transmission line 340.

Unlike as shown in FIG. 8A, the blocking unit 360 may be formed in plurality, and the plurality of blocking units 360 may be connected to the members, respectively. That is, the blocking unit 360 may be connected to at least one of the first, second and third members 310, 320, and 330. In this instance, the blocking unit 360 blocks the member from resonating in the blocking frequency band, thereby improving antenna characteristics.

Referring to FIG. 8A, matching units 371 and 372 may be formed at sides of the members 310 and 320, respectively. The matching units 371 and 372 may be configured with serial elements or shunt elements. In a case where the matching unit is configured with the shunt element, the reactance that is an imaginary component of impedance may be changed. For example, since the inductor increases the reactance and the capacitor decreases the reactance, the impedance in a specific frequency band may be changed. Alternatively, in a case where the matching unit is configured with the shunt element, the resistance that is a real component of impedance may be changed. For example, since the inductor increases the resistance and the capacitor decreases the resistance, the impedance in a specific frequency band may be changed.

First and second feeding units 351 and 352 are parts that supply current to each member operating as a radiator, and may be configured by a combination of a balun, a phase shifter, a distributor, an attenuator, an amplifier, and the like. The first and second members 310 and 320 may be fed by the first feeding unit 351, and the third member 330 may be fed by the second feeding unit 352. The first and second feeding units 351 and 352 independently operate and are electrically isolated from each other, so that it is possible to ensure isolation between the antenna devices without using a separate switch.

Figure 9A:
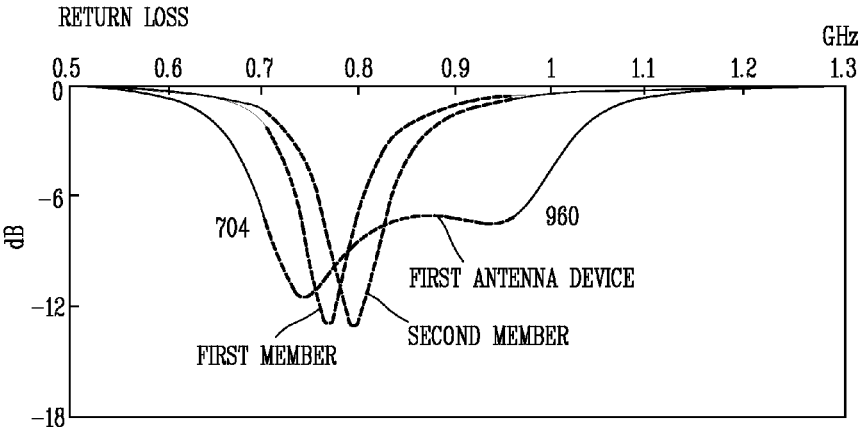
FIG. 9A is a view illustrating reflection coefficients with respect to frequencies of a first antenna.
Figure 9B:
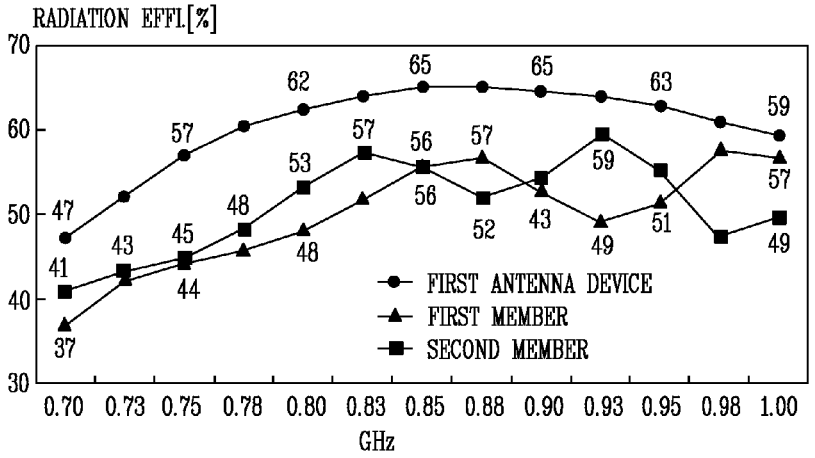
FIG. 9B is a view illustrating radiation efficiencies with respect to frequencies of the first antenna.

FIG. 9A is a view illustrating reflection coefficients with respect to frequencies of a first antenna. FIG. 9B is a view illustrating radiation efficiencies with respect to frequencies of the first antenna.

In the first antenna device ANT 1 of the antenna module according to the embodiment of the present disclosure, when the first member 310 forms a magnetic field in the near field, the second member 320 is configured to form an electric field, and therefore, the magnetic and electric fields are intensified while influencing each other due to the magneto electric effect. Accordingly, the intensity of radiated signals is enhanced, thereby improving the efficiency and bandwidth of the antenna.

As shown in FIG. 9A, it can be seen that the bandwidth of the antenna when the first and second members 310 and 320 operate as dipole antennas while causing the magneto electric effect is increased by twice or more as compared with that when the first and second members 310 and 320 independently operate as monopole antennas.

As shown in FIG. 9B, it can be seen that the radiation efficiency of the antenna when the first and second members 310 and 320 operate as dipole antennas while causing the magneto electric effect is increased as compared with that when the first and second members 310 and 320 independently operate as monopole antennas.

Figure 9C:
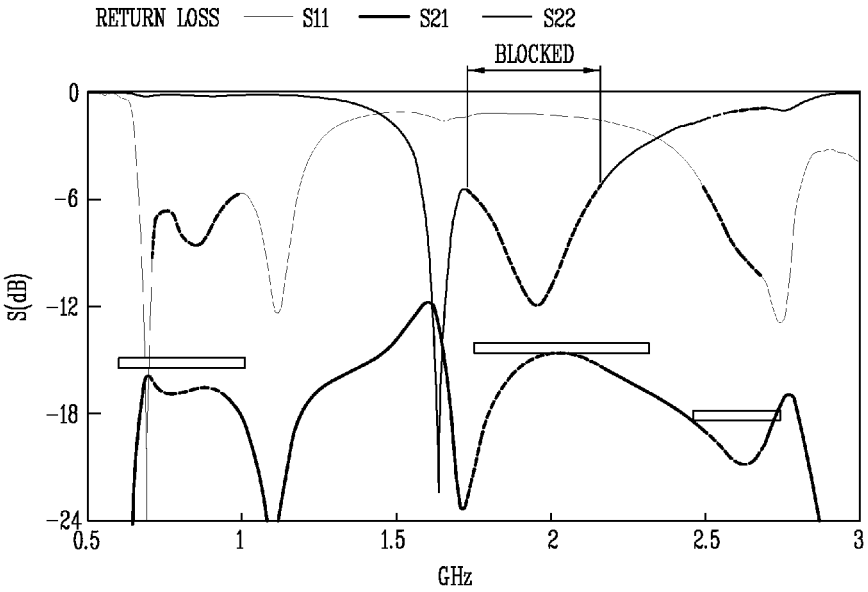
FIG. 9C is a view illustrating reflection coefficients with respect to frequencies in the antenna module shown in FIG. 7.

FIG. 9C is a view illustrating reflection coefficients with respect to frequencies in the antenna module shown in FIG. 7.

Referring to FIG. 9C, it can be seen that the first antenna device ANT 1 including the first and second members 310 and 320, as shown through S11, and the resonance of the first antenna device ANT 1 is blocked by the blocking unit 360 at a frequency band of about 2 GHz that is a harmonic frequency. Also, it can be seen that the second antenna device ANT 2 including the third member 330, as shown through S22, resonates in a frequency band of about 2 GHz.

In this instance, the isolation characteristic between the antenna devices can be seen through S22. The isolation degree of the second antenna device is −15 dB or more due to interference caused by the harmonic frequency of the first antenna device. That is, it can be seen that although the first and second antenna devices ATN 1 and ATN 2 are formed adjacent to each other in one antenna module 300, the blocking unit 360 blocks the harmonic frequency at which the first antenna device ANT 1 operates in the blocking frequency band, thereby reducing electromagnetic interference between the antenna devices. Accordingly, it is possible to reduce degradation of the antenna performance of the second antenna device ANT 2 in a high frequency band.

As described above, in the antenna module 300 according to the embodiment of the present disclosure, two or more antenna devices can be complexly in one antenna module, and each antenna device can maintain antenna performance more than a predetermined level.

Figure 9D:
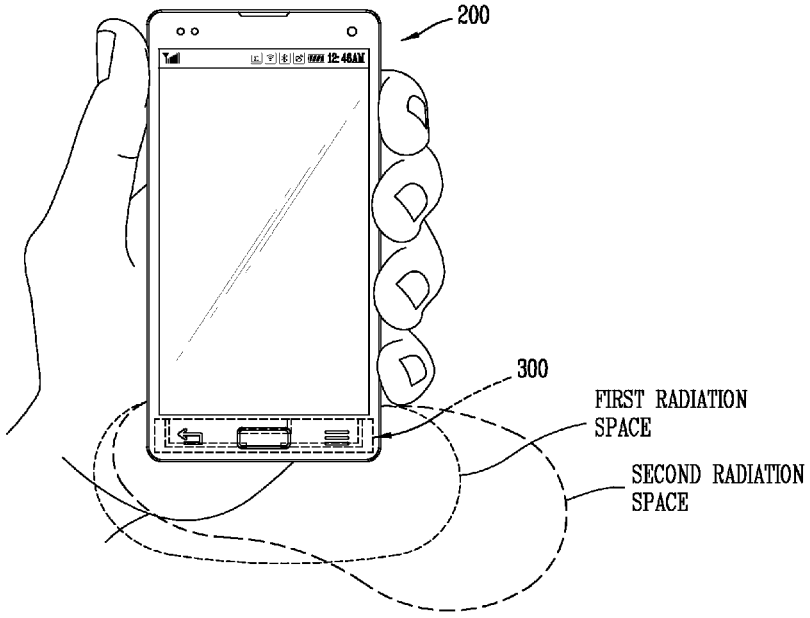
FIG. 9D is a view illustrating a change in radiation space due to a hand effect.

FIG. 9D is a view illustrating a change in radiation space due to a hand effect.

The antenna module 300 of the present disclosure can reduce a body effect caused by a user, particularly when the antenna module 300 is disposed at a lower portion of the terminal body. The body effect refers to a phenomenon that when a specific portion of a mobile terminal is contacted with or approaches a human body, the characteristics of an antenna are changed. For example, when the user holds a specific portion of the mobile terminal with a user's hand, the reception rate of the antenna may be lowered, which is also referred to as a body effect.

As shown in FIG. 9D, when the user holds a mobile terminal in which an antenna module is mounted, the radiation space of the antenna module according to the embodiment of the present disclosure may be changed (from a first radiation space to a second radiation space). That is, in the first antenna device ANT 1, the first and second members 310 and 320 are fed by one feeding unit, and therefore, radio signals are radiated through both the first and second members 310 and 320. Also, the first and second members 310 and 320 are configured to generate the magneto electric effect. Therefore, if the radiation space of any one member is reduced, the radiation space of another member is enlarged. That is, as shown in FIG. 9D, only the shape of the radiation space is modified, but the radiation space is not shrunk. Hence, the characteristics of the antenna are not changed, and thus the reception rate of the antenna is lowered.

At least one of the first and second members 310 and 320 is disposed in a space not covered by the palm of a user's hand, and thus it is possible to reduce lowering of the reception rate, caused by the body effect.

As shown in FIG. 7, the third member 330 is disposed in the space not covered by the palm of the user's hand, and thus it is possible to reduce lowering of the reception rate, caused by the body effect.

Figure 10A:
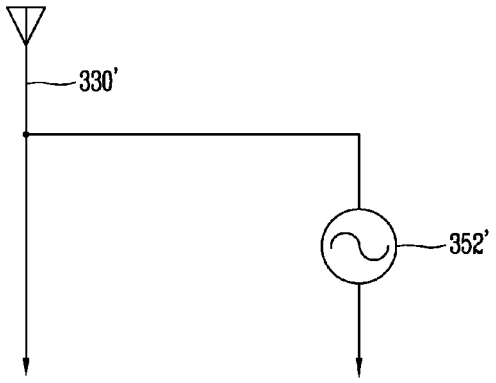
FIGS. 10A and 10B are a view illustrating a comparative example of a second antenna device and a view illustrating reflection coefficients with respect to frequencies.
Figure 10B:
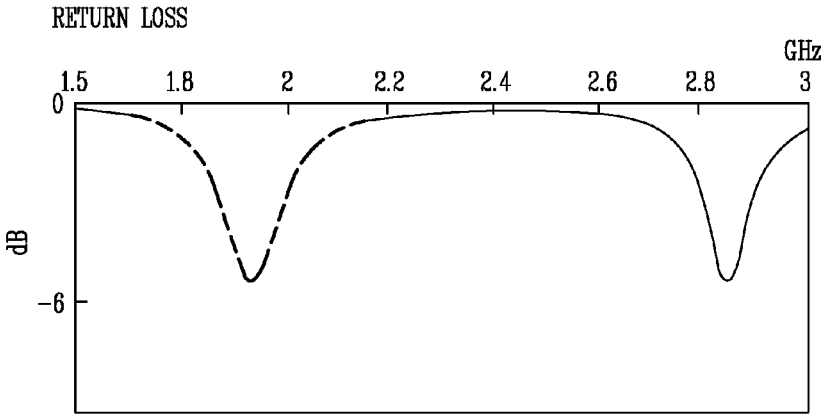

FIGS. 10A and 10B are a view illustrating a comparative example of a second antenna device and a view illustrating reflection coefficients with respect to frequencies.

The antenna device shown in FIG. 10A is a PIFA type antenna device, and may include a conductive member 330' and a feeding unit 352'. The antenna device resonates at a predetermined frequency through feeding of the feeding unit 352'. In this instance, the reflection coefficient of the antenna device has a characteristic of a narrow band as shown in FIG. 10B. Particularly, the bandwidth of the antenna device may be further reduced due to electric or magnetic influence of peripheral elements. Therefore, in a case where the third member 330' operating as the second antenna device ANT 2 is disposed between the first and second members 310 and 320, the performance of the antenna device can be considerably reduced.

Figure 11A:
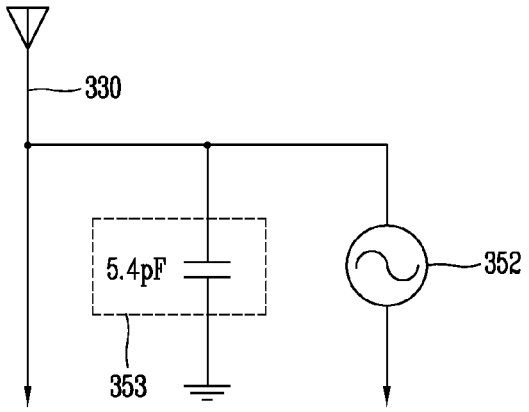
FIGS. 11A and 11B are a view illustrating an embodiment of the second antenna device and a view illustrating reflection coefficients with respect to frequencies.
Figure 11B:
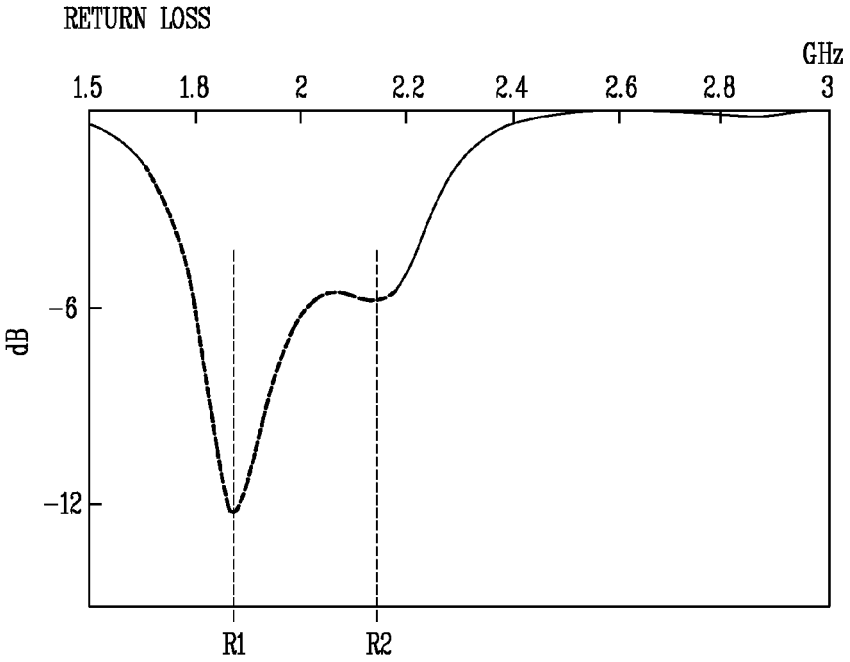

FIGS. 11A and 11B are a view illustrating an embodiment of the second antenna device ANT 2 and a view illustrating reflection coefficients with respect to frequencies.

Referring to FIG. 11A, the second antenna device ANT 2 may include a third member 330, a second feeding unit 352, and a shunt capacitor 353. The third member 330 resonates at a predetermined first resonance frequency R1 through feeding of the second feeding unit 352, and the shunt capacitor 353 may allow the third member 330 to additionally resonate at a second resonance frequency (third frequency) R2 adjacent to the first resonance frequency R1.

As such, dual resonance is formed in adjacent frequency bands, and thus the bandwidth of the antenna device can be improved as shown in FIG. 11B. Accordingly, although the third member 330 operating as the second antenna device is disposed between the first and second members 310 and 320, the performance of the antenna device can be maintained.

Figure 12A:
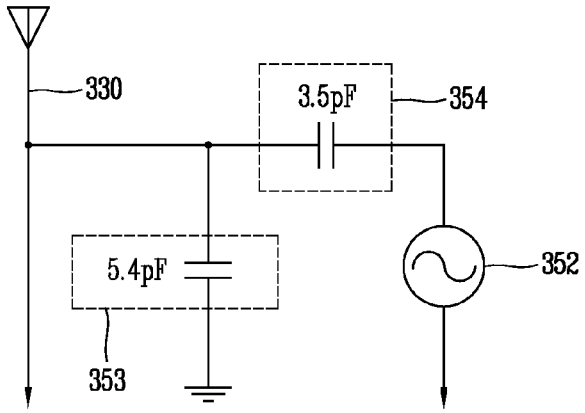
FIGS. 12A and 12B are a view illustrating another embodiment of the second antenna device and a view illustrating reflection coefficients with respect to frequencies.
Figure 12B:
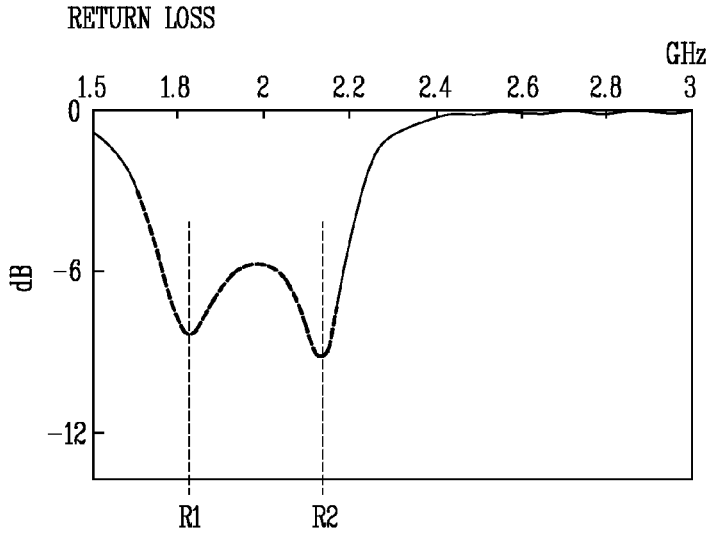

FIGS. 12A and 12B are a view illustrating another embodiment of the second antenna device ANT 2 and a view illustrating reflection coefficients with respect to frequencies.

Referring to FIG. 12A, the second antenna device ANT 2 may include a third member 330, a second feeding unit 352, a shunt capacitor 353, and a series capacitor 354. The third member 330 resonates at a predetermined first resonance frequency R1 through feeding of the second feeding unit 352, and the shunt capacitor 353 may allow the third member 330 to additionally resonate at a second resonance frequency (third frequency) R2 adjacent to the first resonance frequency R1. The antenna efficiency can be improved at the third frequency due to the series capacitor 354 disposed between the third member 330 and the second feeding unit 352.

That is, dual resonance is formed at second and third frequencies adjacent to each other, and reactance is decreased by the series capacitor, so that the bandwidth of the antenna device can be improved as shown in FIG. 12B. Accordingly, although the third member 330 operating as the second antenna device is disposed between the first and second members 310 and 320, superior antenna performance can be maintained.

Figure 13:
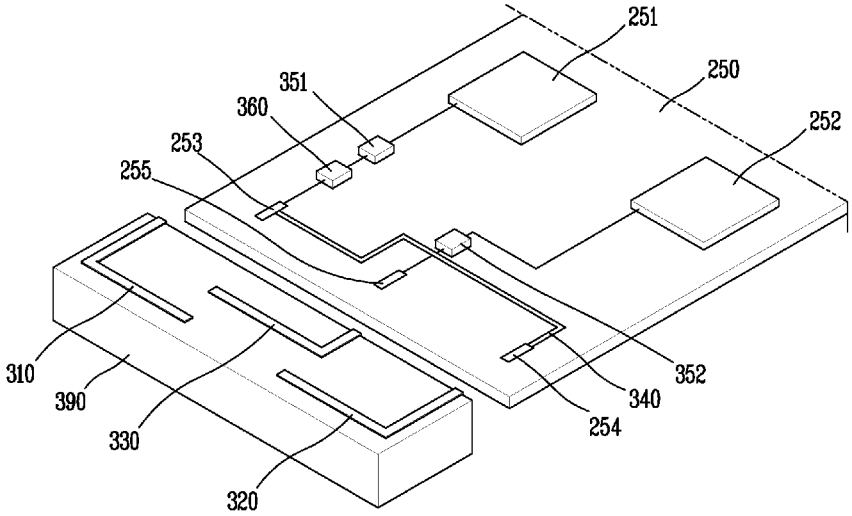
FIG. 13 is a view illustrating an example of the configuration of an antenna module and a circuit board, which are mounted in the mobile terminal.

FIG. 13 is a view illustrating an example of the configuration of an antenna module and a circuit board, which are mounted in the mobile terminal.

Referring to FIG. 10, a transceiver circuit unit may be formed on the circuit board 250.

Here, the circuit board may be the flexible circuit board 242 (see FIG. 4). In addition, the board may be a dielectric board or semiconductor board. A ground may be formed on one surface of the board, or in a case where the board is a multi-layer board, one layer may be a ground. According to an antenna type, one ends of first to third members 310 to 330 may be ground-connected to the ground.

The transceiver circuit unit may be formed in plurality, and each transceiver circuit may be implemented in the form of a communication chip including at least one of a call processor (CP), a modem chip, an RF transceiver chip, and an RF receiver chip. Therefore, each communication chip feeds a conductive member through a feeding unit and a matching unit, to transmit radio signals or receive radio signals received by the conductive member, which are input through the matching unit and the feeding unit, thereby performing a predetermined receiving process such as a frequency conversion process or a demodulating process.

The transceiver circuit unit may be divided into a first communication chip 251 and a second communication chip 252. The first communication chip 251 may transmit or receive radio signals in a low frequency band, and the second communication chip 252 may transmit or receive radio signals in a high frequency band.

In this case, the first and second members 310 and 320 may be connected to each other by a transmission line 340, and the transmission line 340 may be again connected to the first communication chip 251. The transmission line 340 and each of the first and second members may be connected to each other by a connection portion 253 or 254. Also, the third member 330 may be connected to the second communication chip 252 by another connection portion 255.

The connection portions 253, 254 and 255 may be feeding connection portions. The feeding connection portion F electrically connects the feeding unit and the conductive member to each other or feeds the conductive member in an electro-magnetic (EM) feeding manner. For the electrical connection, the feeding connection portion F may include at least one of a feeding plate, a feeding clip and a feeding line. Here, the feeding plate, the feeding clip and the feeding line may be electrically connected to one another, to deliver a current (or voltage) fed by a feeding device to the conductive members transmitting/receiving radio signals. Here, the feeding line may include a microstrip printed on a board.

The antenna module 300 electrically connected to the circuit board 250 may be provided with the first to third members 310 to 330 as described above. The first to third members 310 to 330 are integrally formed on a carrier 390.

As described above, the first and second members 310 and 320 are electrically connected to the first communication chip 251, and the third member 330 is electrically connected to the second communication chip 252. Therefore, the first communication chip 251 is configured to process signals in a low frequency band, and the second communication chip 252 is configured to process signals in a high frequency band. Thus, the first and second communication chips 251 and 252 operate independently to each other. Accordingly, the mobile terminal according to the embodiment of the present disclosure can reduce crosstalk between signals and more efficiently process signals corresponding to different frequency bands.

Although not shown in this figure, a ground connection portion may be formed to connect the ground to the third member constituting a second antenna device ANT 2. The ground connection portion G may electrically connect or disconnect the ground to or from the third member, thereby achieving impedance matching for a resonance frequency of the antenna device. The ground connection portion G may include at least two paths having different lengths and switches corresponding to the respective paths. The paths may selectively connect the electrical ground to radiators (e.g., the conductive members) through the corresponding switches for selecting the paths, to have different lengths. Here, the path is an electrical path for connection between the ground and the radiator, and may include at least one of a ground plate, a ground clip and a ground line. Also, the ground lines may be formed in different lengths, thereby varying the length of the path.

Figure 14:
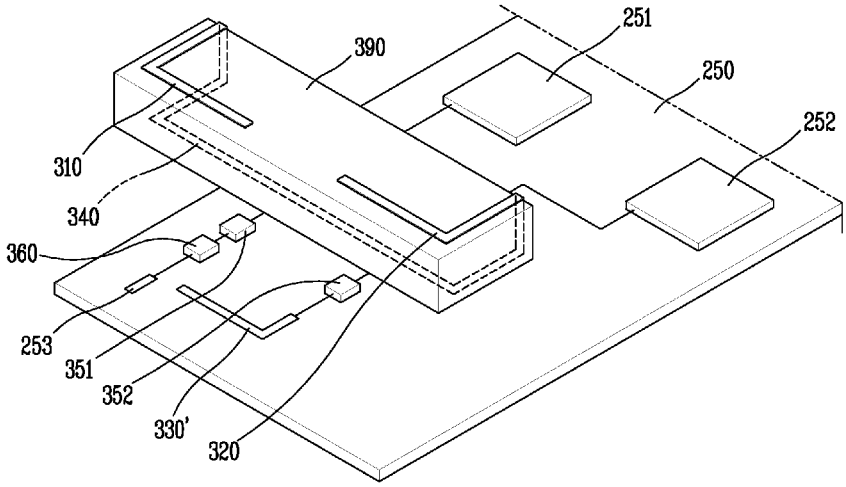
FIG. 14 is a view illustrating another example of the configuration of the antenna module and the circuit board, which are mounted in the mobile terminal.

FIG. 14 is a view illustrating another example of the configuration of the antenna module and the circuit board, which are mounted in the mobile terminal.

Hereinafter, descriptions of components identical to those shown in FIG. 13 will be omitted, and only the components different from those shown in FIG. 13 will be described.

Referring to FIG. 14, the first and second members 310 and 320 may be formed on the carrier 380, and a third member 330' may be formed on the circuit board 250.

When the first and second members 310 and 320 are projected onto the circuit board 250, the third member 330' may be disposed between the projected first and second members 310 and 320. Unlike the aforementioned embodiment, the reason why the third member 330' is formed on the circuit board 250 is that the third member 330' operating in a high frequency band does not require high antenna performance as compared with that operating in a low frequency band. Thus, although the third member 330' is covered by the carrier 390, the third member 330' can maintain excellent antenna performance. Further, the third member 330' is spaced apart from the first and second members 310 and 320, thereby increasing isolation degree between antennas.

Also, a transceiver unit may be formed on the circuit board 250.

Here, the circuit board may be the flexible circuit board 242 (see FIG. 4). In addition, the board may be a dielectric board or semiconductor board. A ground may be formed on one surface of the board, or in a case where the board is a multi-layer board, one layer may be a ground. According to an antenna type, one ends of first to third members 310 to 330 may be ground-connected to the ground.

The transceiver circuit unit may be formed in plurality, and each transceiver circuit may be implemented in the form of a communication chip including at least one of a call processor (CP), a modem chip, an RF transceiver chip, and an RF receiver chip. Therefore, each communication chip feeds a conductive member through a feeding unit and a matching unit, to transmit radio signals or receive radio signals received by the conductive member, which are input through the matching unit and the feeding unit, thereby performing a predetermined receiving process such as a frequency conversion process or a demodulating process.

The transceiver circuit unit may be divided into a first communication chip 251 and a second communication chip 252. The first communication chip 251 may transmit or receive radio signals in a low frequency band, and the second communication chip 252 may transmit or receive radio signals in a high frequency band.

In this case, the first and second members 310 and 320 may be connected to each other by a transmission line 340, and the transmission line 340 may be again connected to the first communication chip 251. The transmission line 340 and each of the first and second members may be connected to each other by a connection portion. Also, the third member 330' may be connected to the second communication chip 252 by another connection portion.

The first and second members 310 and 320 are electrically connected to the first communication chip 251, and the third member 330' is electrically connected to the second communication chip 252. Therefore, the first communication chip 251 is configured to process signals in a low frequency band, and the second communication chip 252 is configured to process signals in a high frequency band. Thus, the first and second communication chips 251 and 252 operate independently to each other. Accordingly, the mobile terminal according to the embodiment of the present disclosure can reduce crosstalk between signals and more efficiently process signals corresponding to different frequency bands.

Embodiments of the present disclosure can be applied to mobile terminals configured to transmit/receive radio signals.

The invention claimed is:

1. An antenna module comprising:

a first member and a second member configured to operate as radiators of an antenna for transmitting/receiving radio signals;

a first feeding unit configured to feed the first and second members;

a transmission line configured to connect the second member to the first feeding unit so that, when the first member forms a magnetic field in a near field, the second member forms an electric field; and a T matching unit including three inductors connected to one another at one branch point is connected to at least one of the first and second members so as to intensify the magnetic field in the near field.

2. The antenna module of claim 1, wherein the first and second members operate as radiators of a dipole antenna.

3. The antenna module of claim 2, comprising:

a third member disposed between the first and second members; and a second feeding unit configured to feed the third member.

4. The antenna module of claim 3, wherein the first and second members resonate at a first frequency, and the third member resonates at a second frequency higher than the first frequency.

5. The antenna module of claim 4, further comprising a blocking unit formed between the first feeding unit and the first and second members to block the first and second members from resonating at a harmonic frequency.

6. The antenna module of claim 5, wherein the third member is configured to resonate in a frequency band that the blocking unit blocks.

7. The antenna module of claim 3, wherein the first to third members are formed on one carrier having a predetermined dielectric constant.

8. The antenna module of claim 3, further comprising a resonance unit formed between the third member and the second feeding unit so that the third member additionally resonates at a third frequency adjacent to the second frequency.

9. The antenna module of claim 8, wherein the resonance unit includes a shunt capacitor configured to form the third frequency together with the third member.

10. The antenna module of claim 1, wherein a matching unit for matching impedance is formed between the first member and the first feeding unit or between the second member and the first feeding unit, and wherein the matching unit is configured with at least one lumped element.

11. A mobile terminal comprising:

a terminal body; and an antenna module mounted in the terminal body, the antenna module operating at a first frequency and a second frequency, wherein the antenna module includes:

a first member and a second member fed by a first feeding unit to resonate at the first frequency;

a third member disposed between the first and second members, the third member being fed by a second feeding unit to operate independently, the third member transmitting/receiving radio signals at the second frequency higher than the first frequency; and a T matching unit including three inductors connected to one another at one branch point and connecting at least one of the first and second members, wherein when the first member connected to the T matching unit is fed, the T matching unit intensifies a magnetic field of the first member, and the second member forms an electric field so as to intensify the magnetic field in a near field.

12. The mobile terminal of claim 11, wherein a matching unit for matching impedance is formed between the first member and the first feeding unit or between the second member and the first feeding unit, and wherein the matching unit is configured with at least one lumped element.

13. The mobile terminal of claim 11, wherein the antenna module further includes a transmission line configured to connect the second member to the first feeding unit so that, when the first member forms a magnetic field in the near field, the second member forms an electric field.

14. The mobile terminal of claim 11, wherein the antenna module further includes a blocking unit configured to block the first and second members from resonating at a harmonic frequency, and wherein the second frequency is included in a frequency band that the blocking unit blocks.

15. The mobile terminal of claim 11, wherein the first and second members operate as radiators of a dipole antenna.

16. The mobile terminal of claim 11, wherein the antenna module further includes a resonance unit formed between the third member and the second feeding unit so that the third member additionally resonates at a third frequency adjacent to the second frequency.

17. The mobile terminal of claim 16, wherein the resonance unit includes a shunt capacitor configured to form the third frequency together with the third member.

18. The mobile terminal of claim 11, wherein the first and second members are formed on one carrier having a predetermined dielectric constant.

19. The mobile terminal of claim 18, wherein the carrier is formed in a predetermined width to be contacted with both side surfaces of the terminal body.

20. The mobile terminal of claim 18, wherein a circuit board is disposed below the carrier, and the third member is formed on the circuit board.

21. The mobile terminal of claim 11, wherein the first and second members are connected to a first communication chip formed on the circuit board, and the third member is connected to a second communication chip formed on the circuit board.

* * * * *